US005616534A

United States Patent [19]

Ito et al.

[11] Patent Number: 5,616,534

[45] Date of Patent: Apr. 1, 1997

[54] SUBLIMATION TYPE THERMOSENSITIVE IMAGE TRANSFER RECORDING MEDIUM

[75] Inventors: Osamu Ito, Numazu; Hideo Sakurai, Shizuoka-ken; Chiharu Nogawa; Shinya Kawahara, both of Numazu, all of Japan

[73] Assignee: Ricoh Company, Ltd., Tokyo, Japan

[21] Appl. No.: 536,606

[22] Filed: Sep. 29, 1995

[30] Foreign Application Priority Data

Sep. 29, 1994 [JP] Japan ..... 6-259376

[51] Int. Cl.[6] ..... B41M 5/035; B41M 5/38

[52] U.S. Cl. ..... 503/227; 427/146; 427/256; 428/195; 428/409; 428/913; 428/914

[58] Field of Search ..... 8/471; 428/195, 428/409, 913, 914; 503/227; 427/146, 256

[56] References Cited

U.S. PATENT DOCUMENTS 4,880,768 11/1989 Mochizuki et al. ..... 503/227
5,049,538 9/1991 Mochizuki et al. ..... 503/227

FOREIGN PATENT DOCUMENTS 02-233292 9/1990 Japan ..... 503/227

*Primary Examiner*—B. Hamilton Hess
*Attorney, Agent, or Firm*—Oblon, Spivak, McClelland, Maier & Neustadt, P.C.

[57] ABSTRACT

A sublimation type thermosensitive image transfer recording medium is disclosed which is adapted for imagewise transferring an ink from a surface thereof to a recording sheet when heated imagewise with the recording sheet being superimposed thereon. The recording medium includes a support, and a transferable ink layer provided on the support, wherein the surface from which the ink is imagewise transferred to the recording sheet has a waviness of not greater than 2.0 μm in terms of maximum filtered waviness.

11 Claims, 1 Drawing Sheet

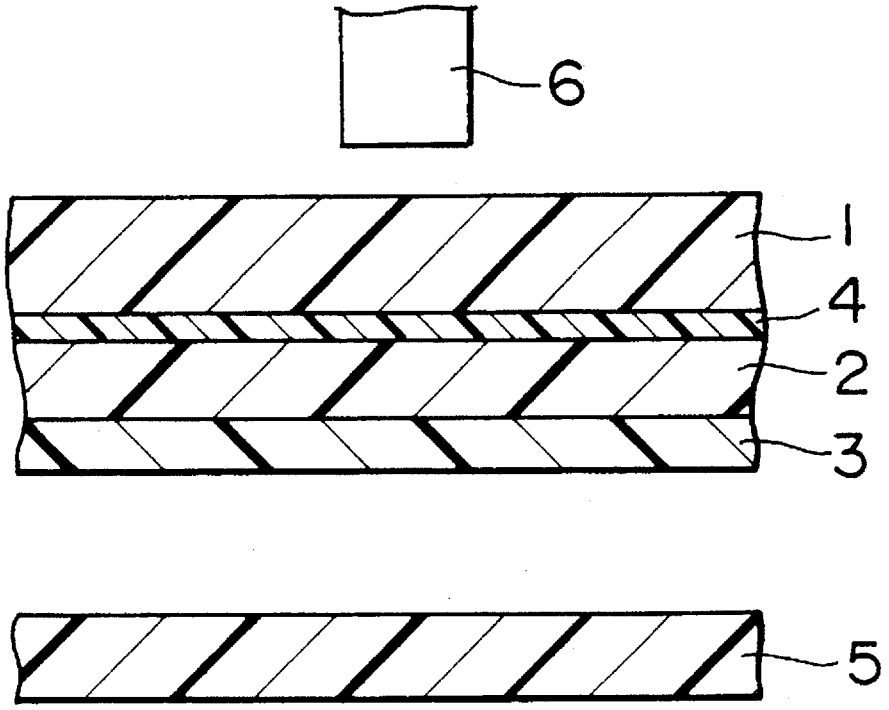
6
1
4
2
3
5

SUBLIMATION TYPE THERMOSENSITIVE IMAGE TRANSFER RECORDING MEDIUM

BACKGROUND OF THE INVENTION

This invention relates to a sublimation type thermosensitive image transfer recording medium and to a method of producing same.

A sublimation type thermosensitive image transfer recording medium is of a type which is adapted for imagewise transferring an ink by sublimation or volatilization from a surface thereof to a recording sheet when heated imagewise by a laser beam or a thermal head with the recording sheet being superimposed thereon.

Since a sublimable dye is sublimated in the form of independent molecules in an amount corresponding to the thermal energy applied thereto, the sublimation type thermosensitive image transfer recording medium can afford half-tone images without difficulty. The sublimation image transfer recording method, however, has a drawback in that the running cost thereof is high, because an ink ribbon having sequentially aligned yellow, magenta, cyan and, if necessary, black sections is discarded after the recording, even though large portions remain unused on each color section.

To cope with this problem with the above one-time type recording medium, there has been proposed a multiple-times type ink ribbon used in the following two modes: (1) an equal mode in which an ink sheet and a receiving sheet are displaced through the same distance upon every printing operation of, for example, a thermal head, so that a first portion of the ink sheet used in one printing operation abuts on a second portion of the ink sheet used in the next printing operation and (2) an n-times mode in which the feeding distance in every printing operation of the receiving sheet is n-times (n>1) that of the ink sheet (in other words, the feeding rate of the ink sheet relative to the thermal head is smaller than that of the receiving sheet) so that a first portion of the ink sheet used in one printing operation overlaps a second portion of the ink sheet used in the next printing operation (U.S. Pat. No. 4,880,768 and U.S. Pat. No. 5,049,538). The N-time mode is advantageous over the equal mode, because the length of each of the color sections in the ink ribbon can be reduced to 1/n and because the ink in each color section is generally evenly consumed.

While the control of the surface roughness as taught in U.S. Pat. No. 5,049,538 is effective in improving the retentivity of sensitivity of the recording medium in repeated use, it has been found that, with the known multiple-times recording medium, the image density is not uniform especially when the thickness of the ink layer is increased. In the multiple-times recording medium especially for use in the n-times mode, it is important that the ink layer should have a large thickness.

SUMMARY OF THE INVENTION

It has now been found that a screen printing method is best suited for the formation of the ink layer of the multiple-times recording medium. However, a new problem of surface waviness has been found to be caused when screen printing is adopted. Namely, traces of the mesh appear in the coated ink layer and results in surface waviness which prevents uniform contact between the recording medium and the receiving sheet so that the variation of image density is caused. A defect on the surface of the recording medium results in a n-times amplified defect in the printed image.

In accordance with the present invention there is provided a sublimation type thermosensitive image transfer recording medium adapted for imagewise transferring an ink from a surface thereof to a recording sheet when heated imagewise with the recording sheet being superimposed thereon, the recording medium comprising a support, and a transferable ink layer provided on the support, wherein the surface has a waviness of not greater than 2.0 μm in terms of maximum filtered waviness.

Preferably, the surface of the recording medium has a waviness of not greater than 1.5 μm in terms of filter maximum waviness in the direction perpendicular to the displacing direction of the recording medium.

It has been found that the waviness of a surface of the recording medium which is contacted with an image receiving sheet has a great influence upon the uniformity of the image density. Images free of variation in image density are obtainable when the maximum filtered waviness is 2.0 μm or less.

The term "maximum filtered waviness" used herein is as defined in Japanese Industrial Standard (JIS) B 0610 (1987), the essential portion of which is as follows:

The term "PROFILE" is defined as a contour seen on a sectional plane of a surface to be measured, which sectional plane is obtained by cutting the surface along a plane perpendicular to the surface.

The term "FILTERED WAVINESS CURVE" is defined as a curve obtained by removing short wavelength components, attributed to the surface roughness, from the profile using a low-pass filter.

The term "CUT-OFF VALUE" is a wavelength corresponding to the frequency at which the gain is 70% in a case where the low-pass filter having an attenuation ratio of −12 dB/oct is used in obtaining the filtered waviness curve. In the case of the present specification, the cut-off value is 0.08 mm.

The term "REFERENCE LENGTH OF FILTERED WAVINESS CURVE" is defined as a length of that portion having a specified length which is sampled from the filtered waviness curve. In the case of the present specification, the reference length is 8 mm.

The term "MEAN LINE OF FILTERED WAVINESS CURVE" is defined as a straight line determined such that the sum of the squares of the deviations from that line to the curve of the filtered waviness curve is minimal.

The term "MAXIMUM FILTERED WAVINESS" is defined as a distance (μm) between two straight lines which are parallel to the mean line of the filtered waviness curve, between which the filtered waviness curve having the reference length is contained and each of which is in contact with a part of the filtered waviness curve. The distance is measured along the direction perpendicular to the mean line.

In the present specification, the maximum filtered waviness of the surface of a recording medium is expressed as an average of the values obtained by measurement at 10 different portions of the surface selected at random.

In another aspect, the present invention provides a method of preparing a sublimation type thermosensitive image transfer recording medium, comprising applying a coating liquid containing a sublimable dye on a surface of a support by screen printing using a screen having a mesh size of at least 200 mesh, said coating liquid having a viscosity of not greater than 30 Pa.sec at a temperature of 25° C. and a rate of shear of 3.8 $sec^{-1}$.

It is, therefore, an object of the present invention to provide a sublimation type thermosensitive image transfer recording medium capable of affording a clear image with uniform density on a receiving sheet.

Another object of the present invention is to provide a sublimation type thermosensitive image transfer recording medium which can be suitably used as a multiple-times type ribbon, especially in the n-times mode printing.

It is a further object of the present invention to provide a method which can prepare a sublimation type thermosensitive image transfer recording medium capable of affording a clear image with uniform density on a receiving sheet.

BRIEF DESCRIPTION OF THE DRAWING

Other objects, features and advantages of the present invention will become apparent from the detailed description of the preferred embodiment which follows, when considered in light of the accompanying drawing, in which the sole FIGURE is sectional view schematically illustrating one embodiment of a sublimation type thermosensitive image transfer recording medium according to the present invention.

DETAILED DESCRIPTION OF THE PREFERRED EMBODIMENTS OF THE INVENTION

Referring to the FIGURE, the reference numeral 1 denotes a support on which a transferable ink layer 2 is formed. Interposed between the support 1 and the ink layer 2 is an optional adhesive layer 4 to firmly bond the ink layer 2 to the support 1. Designated as 6 is a thermal head operable to imagewise heat the recording medium so that the ink is transferred from the ink layer 2 to an image receiving sheet 5.

The support 1 may be, for example, a condenser paper or a film of polyester, polystyrene, polysulfone, polyimide or polyaramide. If desired, a conventionally employed adhesive layer may be interposed between the support and the transferable ink layer. Further, the support may be backed by a conventional heat resistant lubrication layer on the opposite side of the ink layer.

The ink layer 2 may be of a single layer structure or a multilayer structure containing a dye. The ink layer 2 preferably has a gradient in the dye concentration or in the diffusion coefficient of the dye for reasons of adaptability of the recording medium to multiple uses. It is also preferred that the dye incorporated into the ink layer 2 be in the form of particles having a particle size of 0.01–20 μm, preferably 0.1–1 μm. With a suitably selected combination of a dye, a binder and a solvent for a coating liquid for the ink layer, part of the dye can be present in the ink layer in the form of particles without being dissolved in the binder when the coating liquid is applied and dried to form the ink layer. The presence of such dye particles can be determined by analysis with an electromicroscope.

The transferable ink layer 2 preferably has a thickness of at least 3 μm for reasons of minimization of variation in image density.

The sublimable dyes available for use in the transferable ink layer are those employed conventionally, which are volatilized or sublimed at 60° C. or above, especially those employed in thermal transfer printing, for example, disperse dyes and oil-soluble dyes. Specific examples of such dyes include C.I. Disperse Yellow 1, 3, 8, 9, 16, 41, 54, 60, 77 and 116; C.I. Disperse Red 1, 4, 6, 11, 15, 17, 55, 59, 60, 73 and 83; C. I. Disperse Blue 3, 14, 19, 26, 56, 60, 64, 72, 99 and 108; C.I. Solvent Yellow 77 and 116; C.I. Solvent Red 23, 25 and 27; and Solvent Blue 36, 83 and 105. These dyes can be used alone or in combination.

The binder agents available for use in the transferable ink layer 2 are thermoplastic resins and thermosetting resins. Resins having relatively high glass transition points or relatively high softening points may be suitably used. Examples of such resins polyamide, polyethylene, polycarbonate, polystyrene, polypropylene, acrylic resins, phenolic resins, polyester, polyurethane, epoxy resins, silicone resins, fluorine-containing resins, butyral resins, melamine resins, natural rubber, synthetic rubber, polyvinyl alcohol and cellulose resins. The resins can be used alone or in combination, or in the form of copolymers.

The weight ratio of the sublimable dye to the binder is preferably 5:1 or less for reasons of obtaining uniform images.

If desired, an image transfer facilitating layer (not shown) containing a resin compatible with the sublimable dye in the ink layer 2 may be provided over the surface of the ink layer 2 to facilitate the transference of the dye to an image receiving sheet 5. The image facilitating layer may contain the sublimable dye in a concentration lower than that in the ink layer 2, if desired. The image facilitating layer generally has a thickness of 0.05–5 μm, preferably 0.1–1.5 μm.

An overcoat layer 3 having a low tendency to be dyed (or having low affinity with the sublimable dye in the ink layer 2) is preferably provided over the surface of the transferable ink layer 2 to prevent the formation of ghost on image the receiving sheet 5. The overcoat layer 3 may be a resin layer free of the above sublimable or volatilizable dyes and having a thickness of generally about 0.05–5 μm, preferably 0.1–2.0 μm. Illustrative of suitable resins for use in the overcoat layer are aromatic polyester resins, styrene-butadiene resins, polyvinyl acetate resins, polyamide resins, methacrylate resins, styrene-maleate resins, polyimide resins, acetate resins, silicone resins, styrene-acrylonitrile resins, polysulfone resins, cellulose resins, gelatine, polyvinyl alcohol, polyacrylate, polymethacrylate, polyacrylamide, hydrophilic urethane resins and hydrophilic acrylic resins.

Especially suitable resins for the overcoat layer 3 are those which affords a sheet that shows a recording density of 1.2 or less, more preferably 1.0 or less when subjected to the following printing test:

A sample resin is dissolved in a volatile solvent to form a solution having a resin content of 5–20% by weight. The solution is mixed with a 1:1 blend of modified silicone coil SF411 and SF8427 (both manufactured by Toray Silicone Inc.) to obtain a coating liquid having a solid resin content of 30% by weight. The coating liquid is applied on a synthetic paper YUPO EPG#95 (manufactured by Oji Petrochemical Inc.) and dried at 70° C. for 1 minute and at room temperature for 1 or more days to form a resin layer having a thickness of about 10 μm. The thus obtained laminate is overlaid with a color sheet for Mitsubishi Color Video Processor SCT-CP200 and a cyan ribbon and recording is performed with 2.00 mj/dot. The recorded material is measured for the image density using a reflection type densitometer RD-918

The overcoat layer 3 may be formed by applying a coating liquid containing the above resin dissolved in a solvent. The solvent may be suitably selected from those into which the dye of the transferable ink layer is hardly soluble and is preferably one which contains at least 80% of an alcohol. The alcohol may be, for example, methanol, ethanol, n-propanol, n-butanol, isopropanol, isobutanol, secondary butanol, tertially butanol, n-hexanol, 2-ethylbutanol, n-octanol, 2-ethylhexanol, cyclohexanol or dibenzyl alcohol.

It is preferred that the overcoat layer 3 contain a hydrolysis product of a mixture of a difunctional silane coupling agent with a trifunctional silane coupling agent to prevent sticking. The hydrolysis product has a three-dimensional structure. Illustrative of suitable difunctional silane coupling agents are dimethyldichlorosilane, diphenyldichlorosilane, dimethyldimethoxysilane, dimethyldietthoxysilane diphenyldimethoxysilane, γ-glycidoxypropyl-methyldiethoxysilane and N-β-(aminoethyl)-γ-aminopropylmethyldimethoxysilane Illustrative of suitable trifunctional silane coupling agents are methyltrichlorosilane, phenyltrichlorosilane, methyltrimethoxysilane, phenyltriethoxysilane, γ-methacryloxypropyltrimethoxysilane, γ-aminopropyltrimethoxysilane and γ-chloropropyltrimethoxysilane.

The surface structure of the ink layer 2 largely depends on a method by which the ink layer is prepared. Satisfactory surface characteristics may be obtained by a coating method using a roll coater or a nozzle coater in which the coating liquid only is brought into direct contact with a surface to be coated. However, such a method is ill-suited for the formation of an ink ribbon of a field sequential mode; i.e. it is desirable to adopt a gravure printing method, a screen printing method or a rod coater method. These methods, however, are apt to cause a surface waviness.

It is preferred that the ink layer 2 be formed by screen printing and that the screen printing be performed with a screen having a mesh size of 200 mesh (Tyler) or finer. It is also preferred that the ink layer 2 be formed from a coating liquid having a viscosity of not greater than 30 Pa.sec, more preferably 10 Pa.sec, at a temperature of 25° C. and at a rate of shear of 3.8 $sec^{-1}$. It is also advisable not to use a volatile solvent for the formation of the coating liquid.

The use of granular dye tends to cause a surface roughness of the ink layer 2. It is preferred that the ink layer 2 be flattened by being pressed, with heating if necessary, to a flat surface such as a metal roll which has been polished to have a mirror surface, so that the ink layer 2 has an average center-line-roughness of not greater than 0.5 μm.

The center-line-roughness used herein is as measured in the same manner as described with reference to the maximum filtered roughness except that the reference length is 4 mm and the low band cut-off value is 0.08 mm. In the present specification, the average center-line-roughness of the surface of a recording medium is an average of the values obtained by measurement at 10 different portions of the surface selected at random.

In the present invention, thermal image transfer may be carried out by use of a thermal head, by laser beams, using a support which absorbs laser beams and generates heat therefrom, or by causing an electric current to flow through the support and/or an ink-containing layer formed thereon so as to generate Joule's heat therein, that is, by the so-called electrothermic non-impact printing. The electrothermic non-impact printing method is described in may references such as U.S. Pat. No. 4,103,066, JP-A-57-14060, JP-A-57-11080 and JP-A-59-9096.

When the electrothermic non-impact printing method is employed, as the support for the thermosensitive image transfer recording medium according to the present invention, supports which are modified to have an intermediate electric resistivity between electroconductive materials and insulating materials, for example, by dispersing finely divided electroconductive particles, such as finely divided metal particles of aluminum, copper, iron, tin, zinc, nickel, molybdenum and silver, and/or carbon black, in a resin having relatively good heat resistance, such as polyester, polycarbonate,, nylon, polyimide and aromatic polyamide, or by using a support of the abovementioned resins, with the above mentioned electroconductive metals deposited thereon by vacuum deposition or sputtering.

It is preferable that the thickness of such supports be in the range of about 2–15 μm, when the thermal conductivity thereof for the generated Joule's heat is taken into consideration.

As mentioned above, when laser beams are employed for image transfer, it is preferred that the support absorb laser beams and generates heat. For this purpose, for example, a support having a conventional thermal transfer film with addition thereto a material which absorbs heat and convert the light into heat, such as carbon black, may be employed. Alternatively, a light absorbing and heat generating layer may be laminated on the front and/or back side of the support.

The following examples will further illustrate the present invention. Parts are by weight.

EXAMPLE 1

A coating liquid (1) having the composition shown below was applied with a wire bar on an aromatic polyamide film having a thickness of about 6 μm and backed by an about 1 μm thick heat resistant layer of a silicone resin, thereby to form thereon an adhesive layer having a thickness of about 1 μm when dried.

Coating Liquid (1) for Adhesive Layer:

| | |
|---|---|
| Polyvinyl butyral resin (BX-1 manufactured by Sekisui Kagaku Inc.) | 10 parts |
| Diisocyanate (CORONATE manufactured by (Nippon Polyurethane Inc.) | 5 parts |
| Methyl ethyl ketone | 185 parts |

On the adhesive layer thus formed was then applied a coating liquid (2), mixed for 72 hours with a ball mill and having the composition shown below, by screen printing using a screen with a mesh size of 350 mesh to form an ink layer having a thickness of about 5 μm when dried.

Coating Liquid (2) for Ink Layer:

| | |
|---|---|
| Polyvinyl butyral resin (BX-1 manufactured by Sekisui Kagaku Inc.) | 7 parts |
| Diisocyanate (CORONATE manufactured by (Nippon Polyurethane Inc.) | 5 parts |
| Forou Brilliant Blue SR | 30 parts |
| 2-Ethylbutanol | 150 parts |

On the ink layer thus formed was then applied a coating liquid (3) having the composition shown below with a wire bar to form an overcoat layer having a thickness of 0.5 μm when dried, thereby obtaining a sublimation type thermosensitive image transfer recording medium.

Coating Liquid (3) for Overcoat Layer:

| | |
|---|---|
| Styrene-maleic acid copolymer (SPRAPEARL AP30 manufactured by BASF) | 5 parts |
| Liquid A *1 | 20 parts |
| Ethanol | 20 parts |

*1: Liquid A was obtained as follows: Into a mixed liquid of 12 g of toluene and 12 g of methyl ethyl ketone, 15 g of dimethoxysilane and 9 g of methyltrimethoxysilane were dissolved. This solution was mixed with 13 ml of 3% sulfuric acid and the mixture was hydrolyzed for 3 hours to obtain Liquid A.

EXAMPLES 2 and 3

Example 1 was repeated in the same manner as above except that the coating liquid (2) for the formation of the ink layer was mixed with the ball mill for 24 hours (Example 2) and 48 hours (Example 3), thereby obtaining recording media.

EXAMPLE 4

Example 1 was repeated in the same manner as above except that the coating liquid (2) for the formation of the ink layer was substituted by a coating liquid (4) having the composition shown below, and that the thickness of the ink layer when dried was reduced to about 4 μm.

Coating Liquid (4) for Ink Layer:

| | |
|---|---|
| Polyvinyl butyral resin (BX-1 manufactured by Sekisui Kagaku Inc.) | 7 parts |
| Diisocyanate (CORONATE manufactured by (Nippon Polyurethane Inc.) | 5 parts |
| Forou Brilliant Blue SR | 20 parts |
| Cyclohexanone | 150 parts |

EXAMPLE 5

Example 1 was repeated in the same manner as above except that an image transfer facilitating layer having a thickness of about 4 μm was additionally formed between the ink layer and the overcoat layer by applying a coating liquid (5) having the composition shown below.

Coating Liquid (5) for Image Transfer Facilitating Layer:

| | |
|---|---|
| Polyvinyl butyral resin (BX-1 manufactured by Sekisui Kagaku Inc.) | 10 parts |
| Polyethylene oxide resin | 3 parts |
| Diisocyanate (CORONATE manufactured by (Nippon Polyurethane Inc.) | 5 parts |
| n-Butanol | 160 parts |

EXAMPLES 6–8

Example 5 was repeated in the same manner as described except that screens having 200 mesh (Example 6), 230 mesh (Example 7) and 400 mesh (Example 8) were each used in place of the screen of 350 mesh for the formation of the ink layer.

EXAMPLES 9 and 10

Example 5 was repeated in the same manner as described except that the thickness of the ink layer was reduced to 2 μm (Example 9) and 3 μm (Example 10).

EXAMPLES 11 and 12

Example 5 was repeated in the same manner as described except that the amount of 2-ethylbutanol in the coating liquid (2) was decreased to 110 parts (Example 11) and 86 parts (Example 12).

Comparative Examples 1–3

Example 5 was repeated in the same manner as described except that 150 parts of 2-ethylbutanol in the coating liquid (2) was replaced by a mixed solvent consisting of 80 parts of 2-ethylbutanol with 120 parts of n-butanol (Comparative Example 1), a mixed solvent consisting of 40 parts of 2-ethylbutanol with 160 parts of n-butanol (Comparative Example 2) or 200 parts of n-butanol (Comparative Example 3).

Comparative Examples 4 and 5

Example 5 was repeated in the same manner as described except that screens having 165 mesh (Comparative Example 4) and 180 mesh (comparative Example 5) were each used in place of the screen of 350 mesh for the formation of the ink layer.

Comparative Examples 6 and 7

Example 5 was repeated in the same manner as described except that the amount of 2-ethylbutanol in the coating liquid (2) was decreased to 75 parts (Comparative Example 6) and 68 parts (Comparative Example 7).

Each of the recording media obtained in Examples 1–12 and Comparative Examples 1–7 was measured for the surface waviness and surface roughness thereof and was further tested for the image transferring performance thereof.

The surface waviness (maximum filtered waviness) and surface roughness (average center-line surface roughness) were measured as follows:

Sample recording medium was wound around and secured to a metal cylindrical drum having a mirror surface and disposed in a horizontal position. A stylus of a measuring device was scanned on the sample in the direction parallel to the axis of the drum.

Measuring conditions were as shown below:

Measuring device: Surface shape Measuring Device MD-s75A manufactured by Tokyo Precision Inc.

Measuring conditions:

Surface waviness:

High band cut-off value: 0.08 mm

Measuring length (reference length): 8 mm

Surface roughness:

Low band cut-off value: 0.08 mm

Measuring length (reference length): 4 mm

Measuring direction: normal to the displacing direction of the recording medium during printing Measuring speed: 0.03 mm/sec The image transfer test was performed by forming dots image on image receiving sheets prepared as follows:

On a synthetic paper having a thickness of about 150 μm (YUPO FP-150 manufactured by Oji Yuka Goseishi K. K.) was applied a coating liquid (6) having the composition shown below for the formation of an intermediate layer. After drying at 75° C. for 1 minute, a coating liquid (7) having the composition shown below was applied on the intermediate layer and then dried to form an image receiving layer. The laminate was then heated at 60° C. for 24 hours for curing.

Coating Liquid (6) for Intermediate Layer:

| | |
|---|---|
| Vinyl chloride-vinyl acetate-vinyl alcohol copolymer (VAGH manufactured by Union Carbide Corporation) | 10 parts |
| Diisocyanate (CORONATE manufactured by (Nippon Polyurethane Inc.) | 5 parts |
| Toluene | 40 parts |
| Methyl ethyl ketone | 40 parts |

Coating Liquid (7) for Image Receiving Layer:

| | |
|---|---|
| Vinyl chloride-vinyl acetate-vinyl alcohol copolymer (VAGH manufactured by Union Carbide Corporation) | 10 parts |

-continued

| | |
|---|---|
| Diisocyanate (CORONATE manufactured by (Nippon Polyurethane Inc.) | 5 parts |
| Amine-modified silicone resin (SF8417 manufactured by Toray Dow Corning Inc.) | 0.5 part |
| Epoxy-modified silicone resin (manufactured by Toray Dow Corning Inc.) | 0.5 part |
| Toluene | 40 parts |
| Methyl ethyl ketone | 40 parts |

The image transfer test was performed as follows:

Printing condition:

Thermal head resolution: 12 dots/mm

Applied energy: 0.64 mj/dott

Applied voltage: 0.16 W/dott

Thermal head pressure: 5 kgf/cm$^2$

Feeding rate:

Receiving sheet: 8.4 mm/sec

Recording medium: 2.8 mm/sec

The image formed on the receiving sheet was evaluated with native eyes and the evaluation was rated as follows:

5: Image density is uniform.

4: Slightly non-uniform density portion is locally present.

3: Slightly non-uniform density portions are present throughout the sheet.

2: Significantly non-uniform density portion are present throughout the sheet.

1: Part of the dots image is not printed at all.

The test results are summarized in Table 1.

TABLE 1

| Example No. | Viscosity (Pa · S) *1 | WCM *2 (μm) | Ra *3 (μm) | Image Uniformity |
|---|---|---|---|---|
| 1 | 9.3 | 1.55 | 0.38 | 5 |
| 2 | 7.5 | 1.61 | 0.63 | 4 |
| 3 | 8.8 | 1.58 | 0.55 | 3 |
| 4 | 7.0 | 1.41 | 0.31 | 4 |
| 5 | 9.3 | 1.43 | 0.33 | 5 |
| 6 | 9.3 | 1.98 | 0.37 | 3 |
| 7 | 9.3 | 1.71 | 0.35 | 4 |
| 8 | 9.3 | 1.38 | 0.36 | 5 |
| 9 | 9.3 | 1.55 | 0.34 | 3 |
| 10 | 9.3 | 1.54 | 0.31 | 4 |
| 11 | 13.3 | 1.68 | 0.33 | 4 |
| 12 | 29.2 | 1.89 | 0.36 | 3 |
| Comp. 1 | 8.9 | 2.16 | 0.32 | 2 |
| Comp. 2 | 9.4 | 2.22 | 0.35 | 1 |
| Comp. 3 | 9.1 | 2.53 | 0.33 | 1 |
| Comp. 4 | 9.3 | 2.11 | 0.38 | 2 |
| Comp. 5 | 9.3 | 2.32 | 0.34 | 1 |
| Comp. 6 | 33.8 | 2.62 | 0.37 | 2 |
| Comp. 7 | 41.1 | 2.86 | 0.33 | 1 |

*1: measured at 25° C. at a rate of shear of 3.8 sec$^{-1}$

*2: maximum filtered waviness.

*3: surface roughness

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. Thermosensitive image transfer recording medium adapted for imagewise transferring an ink from a surface thereof to a recording sheet when heated imagewise with said recording sheet being superimposed thereon, said recording medium comprising a support, and a transferable ink layer comprising a sublimable dye provided on said support, wherein said surface has a waviness of not greater than 2.0 μm in terms of maximum filtered waviness.

2. A recording medium as claimed in claim 1, wherein said transferable ink layer contains particles of a sublimable dye.

3. A recording medium as claimed in claim 1, wherein said transferable ink layer is of a field sequential mode.

4. A recording medium as claimed in claim 1, wherein said surface has an average center-line-roughness of not greater than 0.5 μm.

5. A recording medium as claimed in claim 1, wherein said transferable ink layer has a thickness of at least 3 μm.

6. A recording medium as claimed in claim 1, wherein said surface has a waviness of not greater than 1.5 μm in terms of maximum filtered waviness in the direction perpendicular to the displacing direction of said recording medium.

7. A recording medium as claimed in claim 1, wherein said transferable ink layer is formed by applying a coating liquid on said support by screen printing.

8. A recording medium as claimed in claim 7, wherein said screen printing is performed with a screen having a mesh size of at least 200 mesh.

9. A recording medium as claimed in claim 7, wherein said coating liquid has a viscosity of not greater than 30 Pa.sec at a temperature of 25° C. and a rate of shear of 3.8 sec$^{-1}$.

10. A recording medium as claimed in claim 1, wherein said recording medium and said recording sheet are displaced relative to heating means with which said recording medium is imagewise heated, such that the feeding rate of said recording medium is smaller than that of said receiving sheet.

11. A method of preparing a thermosensitive image transfer recording medium, comprising applying a coating liquid containing a sublimable dye on a surface of a support by screen printing using a screen having a mesh size of at least 200 mesh, said coating liquid having a viscosity of not greater than 30 Pa.sec at a temperature of 25° C. and a rate of shear of 3.8 sec$^{-1}$, wherein the surface of the recording material has a waviness of not greater than 2.0 μm in terms of maximum filtered waviness.

* * * * *

UNITED STATES PATENT AND TRADEMARK OFFICE

CERTIFICATE OF CORRECTION

PATENT NO. : 5,616,534

DATED : APRIL 1, 1997

INVENTOR(S) : OSAMU ITO, ET AL.

It is certified that error appears in the above-identified patent and that said Letters Patent is hereby corrected as shown below:

Column 4, line 9, "such resins polyamide," should read --such resins include vinyl chloride resins, vinyl acetate resins, polyamide,--.

Column 4, line 29, "ghost on image" should read --ghost image on--.

Column 4, line 48, "SF411" should read --SF8411--.

Column 4, line 58, "RD-918" should read --RD-918.--.

Column 5, line 9, "N-β-(aminoethyl)-γ-aminopropylmethyldimethoxysilane Illustrative" should read --N-β-(aminoethyl)-γ-aminopropylmethyldimethoxysilane. Illustrative--.

UNITED STATES PATENT AND TRADEMARK OFFICE

CERTIFICATE OF CORRECTION

PATENT NO. : 5,616,534
DATED : APRIL 1, 1997
INVENTOR(S) : OSAMU ITO, ET AL.

It is certified that error appears in the above-identified patent and that said Letters Patent is hereby corrected as shown below:

Column 5, line 37, "herein is as measured" should read --herein is measured--.

Column 5, line 52, "in may references" should read --in many references--.

Column 5, line 64, "polycarbonate,," should read --polycarbonate,--.

Signed and Sealed this

Seventh Day of July, 1998

Bruce Lehman

*Attest:*

BRUCE LEHMAN

*Attesting Officer*

*Commissioner of Patents and Trademarks*